US007263980B2

(12) United States Patent
Milton

(10) Patent No.: US 7,263,980 B2
(45) Date of Patent: Sep. 4, 2007

(54) PUMP VAPOR DEFLECTOR FOR FUEL PUMP MODULE ASSEMBLY

(75) Inventor: Jeffery J. Milton, Lake Orion, MI (US)

(73) Assignee: Siemens VDO Automotive Corporation, Auburn Hills ( * ) Notice: Subject to any disclaimer, the term of this patent is extended or adjusted under 35 U.S.C. 154(b) by 0 days.

(21) Appl. No.: 11/472,291

(22) Filed: Jun. 22, 2006

(65) Prior Publication Data

US 2006/0288988 A1 Dec. 28, 2006

Related U.S. Application Data

(60) Provisional application No. 60/692,955, filed on Jun. 22, 2005.

(51) Int. Cl.
*F02M 37/04* (2006.01)
*F02M 37/20* (2006.01)

(52) U.S. Cl. ..... 123/509; 123/516; 123/520

(58) Field of Classification Search ..... 123/520, 123/509, 516, 510, 514
See application file for complete search history.

(56) References Cited

U.S. PATENT DOCUMENTS

| | | | | |
|---|---|---|---|---|
| 4,878,816 | A | 11/1989 | Tuckey | |
| 4,922,959 | A | 5/1990 | Sasaki et al. | |
| 4,966,522 | A | 10/1990 | Koyama | |
| 4,974,570 | A * | 12/1990 | Szwargulski et al. | 123/509 |
| 5,146,901 | A | 9/1992 | Jones | |
| 5,330,475 | A | 7/1994 | Woodward et al. | |
| 5,662,455 | A | 9/1997 | Iwata et al. | |
| 5,718,208 | A | 2/1998 | Brautigan et al. | |
| 5,787,865 | A | 8/1998 | Harris et al. | |
| 5,878,726 | A * | 3/1999 | Takahashi et al. | 123/516 |
| 6,029,633 | A * | 2/2000 | Brandt | 123/509 |
| 6,123,511 | A * | 9/2000 | Sertier | 417/87 |
| 6,283,731 | B1 | 9/2001 | Yoshioka | |
| 6,520,163 | B2 | 2/2003 | Yoshioka et al. | |
| 6,675,777 | B2 * | 1/2004 | Gaston et al. | 123/509 |
| 6,915,787 | B2 * | 7/2005 | Yoshioka et al. | 123/457 |
| 6,964,265 | B2 * | 11/2005 | Iwamoto | 123/510 |
| 2005/0045159 | A1 | 3/2005 | Honda et al. | |

FOREIGN PATENT DOCUMENTS

| | | | |
|---|---|---|---|
| JP | 09053539 | A1 | 2/1997 |

* cited by examiner

*Primary Examiner*—Willis R. Wolfe
*Assistant Examiner*—Johnny H. Hoang

(57) ABSTRACT

A fuel pump module assembly includes a fuel pump 10 having an inlet 16 and an outlet 17. The fuel pump 10 is constructed and arranged to send fuel from the outlet to an engine of a vehicle. The fuel pump has a vapor purge port 13 therein constructed and arranged to permit fuel vapor to exit the fuel pump generally downwardly. A pump filter 14 is disposed below the vapor purge port 13 and is associated with the inlet 16 of the fuel pump. The pump filter is constructed and arranged to filter fuel prior to entering the inlet. A vapor deflector 18 is associated with the vapor purge port 13 and is constructed and arranged to deflect vapor, which exits the vapor purge port, so as to continue to move generally downwardly but away from the pump filter.

17 Claims, 2 Drawing Sheets

PUMP VAPOR DEFLECTOR FOR FUEL PUMP MODULE ASSEMBLY

This application is based on U.S. Provisional Application No. 60/692,955, filed on Jun. 22, 2005 and claims the benefit of thereof for priority purposes.

FIELD OF THE INVENTION

This invention relates to fuel pump module assemblies for automotive applications and, more particularly, to a pump vapor deflector to deflect vapor away from a pump filter.

BACKGROUND OF THE INVENTION

Typical fuel pumps for vehicle applications include a vapor purge port at a bottom of the fuel pump to bleed off vapor, especially when the vehicle is operating in hot climate environments. The fuel filter is typically below the fuel pump. It has been determined that when fuel vapor is ejected from the purge port onto the pump filter, cavitation problems can occur with respect to the operation of the fuel pump.

Thus, there is a need to deflect fuel vapor as it exits a vapor purge port of a fuel pump so as be directed away from the fuel filter and thus reduce or eliminate the above-mentioned cavitation issue.

SUMMARY OF THE INVENTION

An object of the invention is to fulfill the need referred to above. In accordance with the principles of the present invention, this objective is achieved by providing a fuel pump module assembly including a fuel pump having an inlet and an outlet. The fuel pump is constructed and arranged to send fuel from the outlet to an engine of a vehicle. The fuel pump has a vapor purge port therein constructed and arranged to permit fuel vapor to exit the fuel pump generally downwardly. A pump filter is disposed below the vapor purge port and is associated with the inlet of the fuel pump. The pump filter is constructed and arranged to filter fuel prior to entering the inlet. A vapor deflector is associated with the vapor purge port and is constructed and arranged to deflect vapor, which exits the vapor purge port, so as to continue to move generally downwardly but away from the pump filter.

In accordance with another aspect of the invention, a fuel pump module assembly includes a fuel pump having an inlet and an outlet. The fuel pump is constructed and arranged to send fuel from the outlet to an engine of a vehicle. The fuel pump has a vapor purge port therein constructed and arranged to permit fuel vapor to exit the fuel pump generally downwardly. A pump filter is disposed below the vapor purge port is associated with the inlet of the fuel pump. The pump filter is constructed and arranged to filter fuel prior to entering the inlet. Means are associated with the vapor purge port for deflecting vapor, which exits the vapor purge port, so as to continue to move generally downwardly but away from the pump filter.

In accordance with yet another aspect of the invention, a pump retaining structure is provided for supporting a fuel pump with respect to a secondary fuel filter and for deflecting vapor away from an initial filter. The pump retaining structure includes a base member constructed and arranged to be coupled to the secondary filter. A pump retainer member is coupled to the base member so as to be in spaced relation with respect to the base member. The pump retainer member is constructed and arranged to retain and support the pump in a suspended manner with respect to the secondary filter. The pump retaining structure also includes a vapor deflector that is constructed and arranged to deflect vapor, exiting a vapor purge port of the fuel pump, away from the initial filter.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawing, wherein like reference numerals refer to like parts, in which.

DETAILED DESCRIPTION OF THE EXEMPLARY EMBODIMENT

Figure 1:
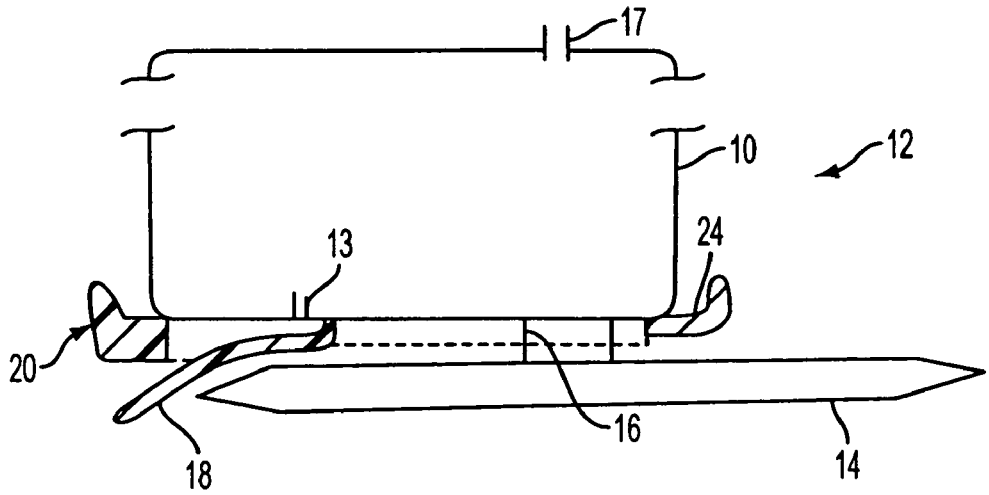
FIG. 1 is a schematic view of a portion of a fuel pump of a fuel pump module assembly showing a vapor deflector in accordance with the principles of the invention.
Figure 2A:
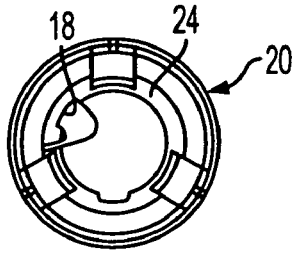
FIG. 2*a* is a bottom view of a pump retaining structure including a vapor deflector in accordance with another embodiment of the invention.
Figure 2C:
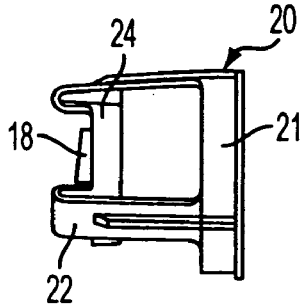
FIG. 2*c* is a side view of the pump retaining structure of FIG. 2*a*.
Figure 2B:
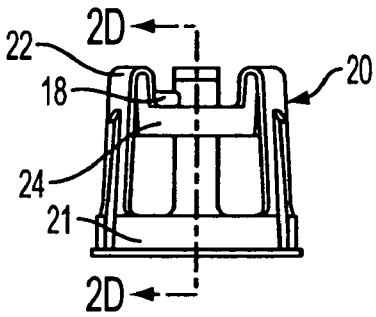
FIG. 2*b* is a front view of the pump retaining structure of FIG. 2*a*.
Figure 2D:
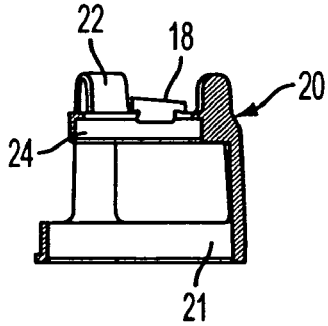
FIG. 2*d* is a sectional view of the pump retaining structure taken along the line 2*d*-2*d* of FIG. 2*b*.

With reference to FIG. 1, a portion of a fuel pump 10 of a fuel pump module assembly, generally indicated at 12, is shown. The module assembly 12 is for use in a vehicle to deliver fuel to an engine and is typically mounted in a fuel tank of a vehicle. A conventional vapor purge port 13 is provided in a bottom of the fuel pump 10 to permit fuel vapor to exit the fuel pump 10 generally downwardly under certain conditions. An initial or pump filter 14 is provided generally under the fuel pump 10. Thus, a portion of the pump filter 14 is below the vapor purge port 13. The pump filter 14 filters fuel in a fuel tank prior to the fuel being received by the fuel pump 10 via inlet 16. Fuel exits the fuel pump 10 at outlet 17 to be received by an engine of a vehicle.

In accordance with an embodiment of the invention, a pump vapor deflector 18 is associated with the fuel pump 10 and thus the vapor purge port 13 to deflect vapor exiting from the purge port 13 to continue to move generally downwardly, but away from the pump filter 14. The vapor deflector 18 can be mounted with respect to the fuel pump 10, a reservoir (not shown) or, as shown in FIG. 1, can be integral with or mounted to a pump retaining structure 20 that supports the fuel pump 10. The pump retaining structure 20 is preferably composed of plastic material that can be exposed to fuel.

FIGS. 2*a*-2*d* show an embodiment of the pump retaining structure, generally indicated at 20, including the integral vapor deflector 18. In the embodiment, the pump retaining structure 20 has a base member 21 of generally cylindrical configuration that is coupled to a secondary filter 23. Spring structure 22 is coupled to the base member 21 at one end thereof with other end of the spring structure 22 being connected to a generally annular pump retainer member 24 that is in spaced relation with respect to the base member 20. The vapor deflector 18 is coupled with the pump retainer member 24.

Figure 3:
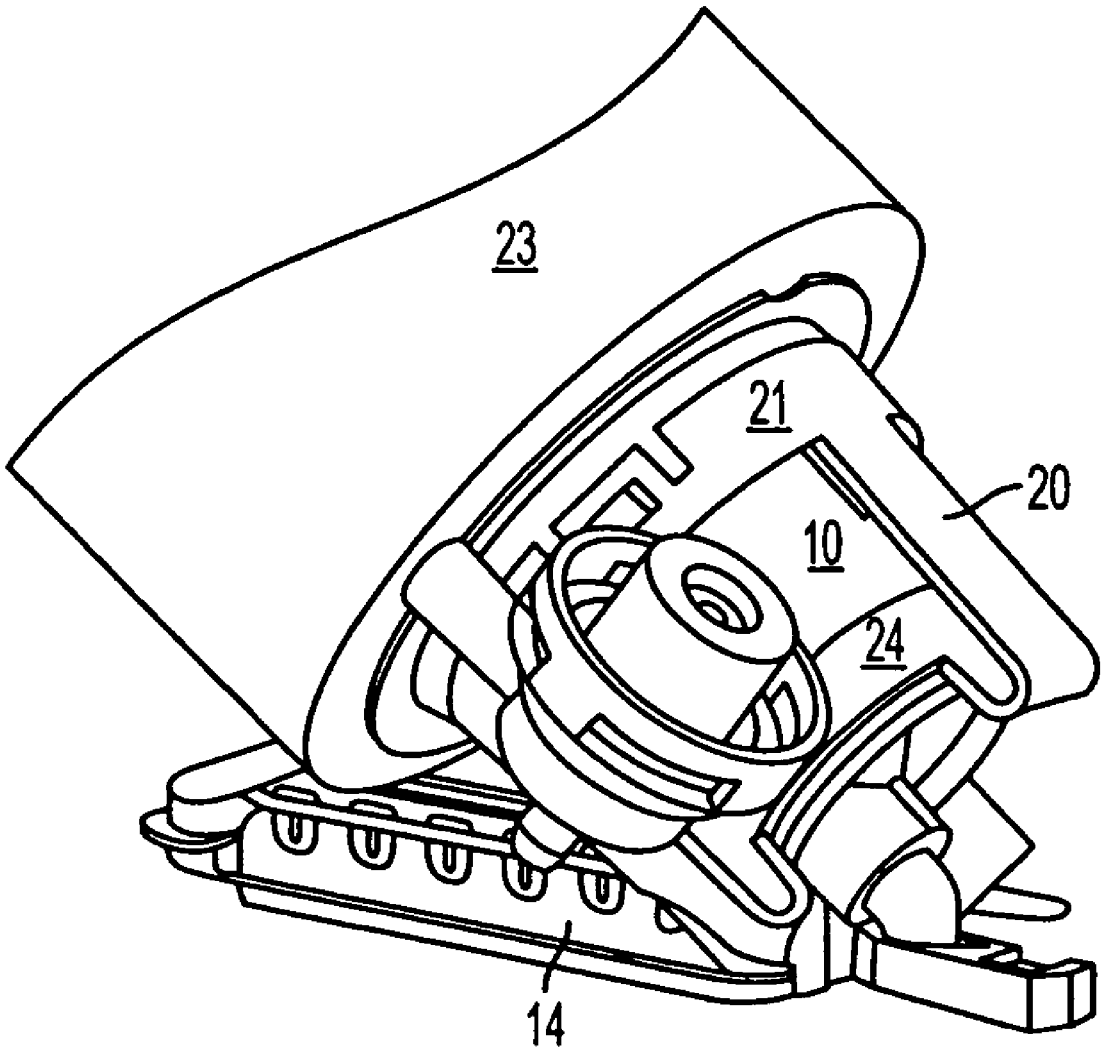
FIG. 3 is a perspective view of the pump retaining structure of FIG. 2*b* shown retaining a fuel pump.

The pump 10 can simply rest on the pump retainer member 24 (FIG. 1) or, as shown in FIG. 3, the pump retainer member 24 can engage an outer surface of the pump 10 so as so resiliently retain and support the pump 10 in a suspended manner with respect to the secondary filter 23. The vapor deflector 18 and purge port 13 are not seen in FIG. 3.

Thus, the deflector 18 reduces the issues with regard to the pump filter 14 drawing vapor directly in during hot fuel conditions.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel pump module assembly comprising:

a fuel pump having an inlet and an outlet, the fuel pump being constructed and arranged to send fuel from the outlet to an engine of a vehicle, the fuel pump having a vapor purge port therein constructed and arranged to permit fuel vapor to exit the fuel pump generally downwardly, a pump filter disposed below the vapor purge port and being associated with the inlet of the fuel pump, the pump filter being constructed and arranged to filter fuel prior to entering the inlet, and a vapor deflector, between the vapor purge port and the pump filter, constructed and arranged to deflect vapor, which exits the vapor purge port, so as to continue to move generally downwardly but away from the pump filter.

2. The assembly of claim 1, further comprising a secondary filter associated with the fuel pump, and a pump retaining structure supporting the fuel pump with respect to the secondary filter.

3. The assembly of claim 2, wherein the vapor deflector is part of the pump retaining structure.

4. The assembly of claim 2, wherein the pump retaining structure supports the fuel pump in a suspended manner with respect to the secondary filter.

5. The assembly of claim 2, wherein pump retaining structure is composed of plastic material.

6. The assembly of claim 4, wherein the pump retaining structure comprises:

a base member coupled to the secondary filter, and a pump retainer member coupled to the base member so as to be in spaced relation with respect to the base member, the pump retainer member supporting the fuel pump.

7. A fuel pump module assembly comprising:

a fuel pump having an inlet and an outlet, the fuel pump being constructed and arranged to send fuel from the outlet to an engine of a vehicle, the fuel pump having a vapor purge port therein constructed and arranged to permit fuel vapor to exit the fuel pump generally downwardly, a pump filter disposed below the vapor purge port and being associated with the inlet of the fuel pump, the pump filter being constructed and arranged to filter fuel prior to entering the inlet, and means for deflecting vapor which exits the vapor purge port so as to continue to move generally downwardly but away from the pump filter, the means for deflecting vapor being disposed between the vapor purge port and the pump filter.

8. The assembly of claim 7, further comprising a secondary filter associated with the fuel pump, and a pump retaining structure supporting the fuel pump with respect to the secondary filter.

9. The assembly of claim 8, wherein the means for deflecting is a deflector that is part of the pump retaining structure.

10. The assembly of claim 8, wherein the pump retaining structure supports the fuel pump in a suspended manner with respect to the secondary filter.

11. The assembly of claim 8, wherein pump retaining structure is composed of plastic material.

12. The assembly of claim 10, wherein the pump retaining structure comprises:

a base member coupled to the secondary filter, a pump retainer member coupled to the base member so as to be in spaced relation with respect to the base member, the pump retainer member supporting the fuel pump.

13. The assembly of claim 12, wherein the deflector is coupled to the pump retainer member.

14. A pump retaining structure for supporting a fuel pump with respect to a secondary fuel filter and for deflecting vapor away from an initial filter, the pump retaining structure comprising:

a base member constructed and arranged to be coupled to the secondary filter, a pump retainer member coupled to the base member so as to be in spaced relation with respect to the base member, the pump retainer member being constructed and arranged to retain and support the pump in a suspended manner with respect to the secondary filter, and a vapor deflector constructed and arranged to deflect vapor, exiting a vapor purge port of the fuel pump, away from the initial filter.

15. The structure of claim 14, wherein the base member, the pump retainer member and the vapor deflector are formed integrally from plastic.

16. The structure of claim 14, wherein the deflector is coupled to the pump retainer member.

17. The assembly of claim 5, wherein the vapor deflector is coupled to the pump retainer member.

* * * * *